United States Patent [19]

Olson et al.

[11] 4,377,061

[45] Mar. 22, 1983

[54] HORIZONTAL PACKAGING APPARATUS

[75] Inventors: Jan C. H. Olson, Braemhult; Karl G. Carlson, Vaestra Froelunda, both of Sweden

[73] Assignee: TEX Innovation AB, Vaestra Froelunda, Sweden

[21] Appl. No.: 197,405

[22] Filed: Oct. 16, 1980

Related U.S. Application Data

[63] Continuation-in-part of Ser. No. 937,383, Aug. 28, 1978, abandoned.

[51] Int. Cl.[3] ..... B65B 31/02; B65B 63/02; B65B 9/02

[52] U.S. Cl. ..... 53/433; 53/436; 53/450; 53/511; 53/526; 53/529; 53/523; 53/548

[58] Field of Search ..... 53/433, 436, 439, 523, 53/450, 529, 511, 548, 526, 547, 553

[56] References Cited

U.S. PATENT DOCUMENTS

| | | | |
|---|---|---|---|
| 3,420,034 | 1/1969 | Saraisky et al. | 53/526 X |
| 3,837,138 | 9/1974 | Terry | 53/439 |
| 3,848,398 | 11/1974 | Suhr | 53/553 X |
| 3,886,713 | 6/1975 | Mitchell | 53/526 X |
| 4,035,983 | 7/1977 | Shanklin et al. | 53/450 |
| 4,110,954 | 9/1978 | Olsson et al. | 53/433 |

*Primary Examiner*—Horace M. Culver

[57] ABSTRACT

A method for wrapping commodities comprising supplying a pair of spaced apart layers of air-impermeable wrapping material and securing the layers together transversely along a leading end. A commodity is inserted between the layers to lie adjacent the secured leading end. The side or sides of the layers are secured together. The layers are then perforated in a transverse row adjacent the commodity on its side opposite the other side adjacent the leading end. The layers are then sealed transversely between the commodity and the row of perforations to completely seal the commodity within the layers. Prior to completely sealing the commodity, but after perforating, the space surrounding the commodity between the layers is evacuated. The invention also covers an apparatus for carrying out the method.

15 Claims, 28 Drawing Figures

HORIZONTAL PACKAGING APPARATUS

This is a continuation-in-part of co-pending application Ser. No. 937,383, filed Aug. 28, 1978, and now abandoned.

This invention relates to a method and apparatus for wrapping commodities and in particular, ones suitable for compression packaging and vacuum wrapping compressible commodities.

The packaging of commodities is essential in the manufacture and distribution of such commodities between the point of manufacture and the point of sale, or the point of use, as the case may be. Transportation costs, as well as handling costs, are not only dependent on the weight of such products, but also on the volume of space such goods occupy. Thus, in the case of bulky goods, it has long been recognized that the concept of reducing the bulk or volume of such goods for transportation and handling purposes can reduce the overall costs. Several proposals have been made in the prior art for reducing the volume of bulky goods and reference may be had to e.g., U.S. Pat. No. 3,511,021 which refers to the fact that it is desirable to reduce the volume of bulky goods for transportation. However, although bulky articles such as insulation material of glass fiber or the like, cushions or the like, can be theoretically reduced to a very small fraction of their initial volume after manufacture, such products are only compressed and then wrapped to a relatively small reduction in their original thickness.

With this invention, applicant has developed an apparatus for compression wrapping and vacuum packaging compressible commodities which is capable of compressing such commodities to a fraction of their original size resulting in reduced handling and transportation problems; in accordance with a further aspect, there is provided a method of vacuum packaging and compressing compressible commodities which can be carried out using the apparatus of this invention.

In a preferred embodiment of the present invention, there is provided a system for wrapping a commodity comprising, in combination, means for supplying a pair of spaced apart layers of air-impermeable wrapping material each having a free lateral edge and for placing said pair of layers of wrapping material in registry, said layers of wrapping material being secured together along a leading edge to form an open-sided partial envelope having a closed leading portion, means for advancing a commodity along a path into engagement with said wrapping material between said layers of wrapping material, means for sealing the free lateral edges of said layers of wrapping material together to form an envelope having at least one closed lateral side and a closed leading portion with said commodity therein, means for perforating said opposed lengths of wrapping material across the width thereof to form a container length, and means for sealing the balance of said pair of layers of wrapping material of the envelope to form a wrapped commodity enclosed in a wrapper.

In a further embodiment of the present invention there is provided a method of wrapping a commodity comprising the steps of supplying a commodity to be wrapped, supplying a pair of spaced apart layers of air-impermeable wrapping material each having a free lateral edge, placing said layers of wrapping material in registry, said layers of wrapping material being secured together along a leading edge to form an open sided partial envelope having a closed leading portion, advancing a commodity along a path into engagement with the wrapping material between said layers of wrapping material, sealing the free lateral edges of said layers of wrapping material.

The pair of opposed lengths of wrapping material, are preferably supplied from one continuous roll of the same. The opposed lengths are brought together in registry in a spaced-apart manner which will permit the feeding of the commodity between the opposed layers of the wrapping material. Prior to feeding the commodity between the opposed layers of wrapping material, the opposed layers are preferably sealed together at the leading end in the direction of movement of the commodity so as to provide a closed leading end. Suitable means such as heat-sealing means may be used.

Suitable means for conveying the commodity along the fixed guide path may include conveyors, movable belts or the like. A compressible commodity may be subjected to a compression step with compression means during the feeding of the same to the packaging operation—for example, a pair of opposed conveyor belts may be arranged in a converging manner to subject the commodity to compression to the desired degree and when compressed, the advancing means for the commodity may then feed the commodity between the opposed layers of wrapping material in a compressed state.

The commodity is then inserted between opposed layers of the wrapping material and then advanced to a side-sealing component, and where the commodity is under compression, the advancing means preferably includes means for retaining the commodity under compression while the side edges are sealed. In a preferred arrangement, there are provided means for engaging the closed leading end of the wrapping material and advancing the same in conjuction with the advancing means for the commodity into engagement or operative relationship with the side-sealing means. Such means preferably comprise retractable fingers or grippers for engaging the interior surface of the pair of layers of wrapping material and for controlling and/or advancing the same into the sealing operation. Such fingers are preferably of a reciprocal nature adapted to advance a bag length of material into operative relationship with the sealing operation and thereafter retract to the original position to subsequently engage a further closed leading end.

In the side-sealing operation, the wrapping material is subjected to a sealing step. The sealing element can be any suitable type. In a preferred version of the sealing means, advancing means for the retaining of control of the commodity between the opposed layers of wrapping material are provided operating in conjunction with the advancing means for advancing a commodity between the opposed layers of wrapping material. Thus, a pair of opposed conveyor belts having a desired height will retain the commodity under compression.

Upon completion of the sealing of the free lateral edges of the wrapping material, there is obtained an envelope having sealed side edges and a sealed leading edge with a trailing end. Thereafter, there are provided means for advancing the commodity into the final sealing operation to both perforate the envelope at its trailing end and to seal the trailing end of the envelope. Preferably there are provided vacuum packaging and sealing means operating in conjunction with each other. The vacuum packaging means preferably comprises a fixed surface and an opposed movable surface, with a vacuum chamber being defined between the two surfaces or alternately, in a housing enclosing the two surfaces. The sealing means, in the latter embodiment, are preferably included in the vacuum chamber as are the perforating means and means are provided for advancing the commodity from the side-sealing operation into the vacuum chamber and subsequently for discharge of the wrapped commodity from the vacuum chamber. In the preferred embodiment means are provided for causing at least one of the surfaces to be brought into and out of engagement with the other—such means may operate to bring the non-fixed surface into engagement with the fixed surface. The non-fixed surface preferably comprises a flexible air-impermeable membrane of suitable rubber or thermoplastic material, which is dimensioned so as to flex and upon creation of a vacuum between the opposed surfaces, to contact the commodity to be wrapped under compression and vacuum in such a manner as to "squeeze" the air from the envelope containing the commodity. Suitable means for creating a vacuum may be provided.

A still further modification of the present invention includes the provision whereby continuous lengths of a length of "C" or "U" film is employed. Using this arrangement, the product or commodity will be side fed into the "C" film so that the product or commodity is spaced apart from one another as the situation may require. In such an arrangement, preferably the film in the form of a U, as it is fed to the sealing section, is sealed transversely, either before or subsequent to the feeding of the commodity to form a "pocket" for the commodity so that after the commodity is fed through the pair of spaced apart layers of film, one side remains open—which may be subsequently sealed in the side sealing step.

Any suitable feeding means for feeding a commodity into the U or C film may be employed. Such means may include mechanical means such as a conveyor for feeding a commodity into the path of advancement of the C film and between the spaced apart layers of film.

The method and apparatus of the present invention, hereinafter described in greater detail with reference to the drawings and illustrating preferred embodiments, has been found to be very useful for packaging commodities under compression. Insulation material such as glass fiber batts, and cushions or the like, may be compressed to a fraction of their original volume.

The various components of the apparatus of the present invention, and likewise the various steps of the method of the present invention, can be carried out in a time-related manner. Thus, for example, one commodity can be fed between a pair of layers of opposed lengths of wrapping material, while a commodity previously inserted is acted on to side-seal the lengths of wrapping material and a still further commodity is subjected to a vacuum packaging operation. Thus, suitable control means may be provided for operating the apparatus in such time-related sequence.

Having thus generally described the invention, reference will now be made to the accompanying drawings, illustrating preferred embodiments and in which.

Figure 14:
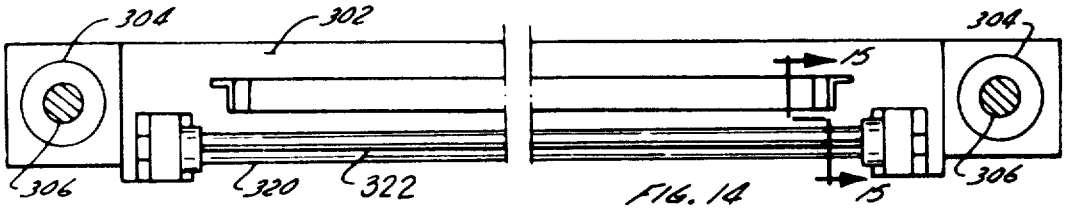
Figure 15:
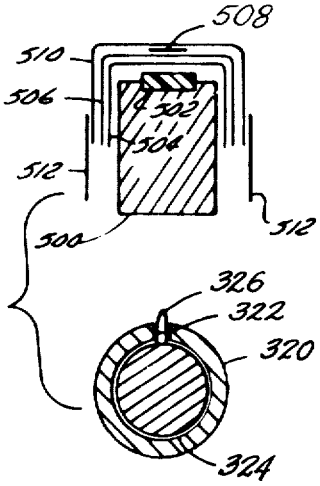
Figure 5:
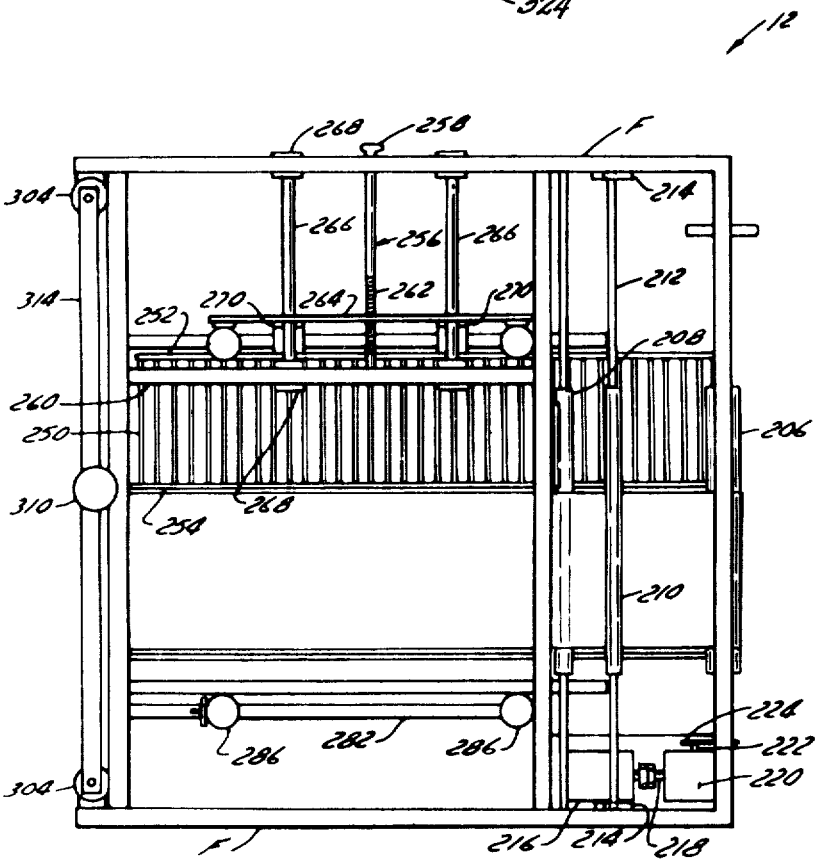
FIG. 5 is a top plan view of the apparatus of FIGS. 3 and 4.
Figure 6:
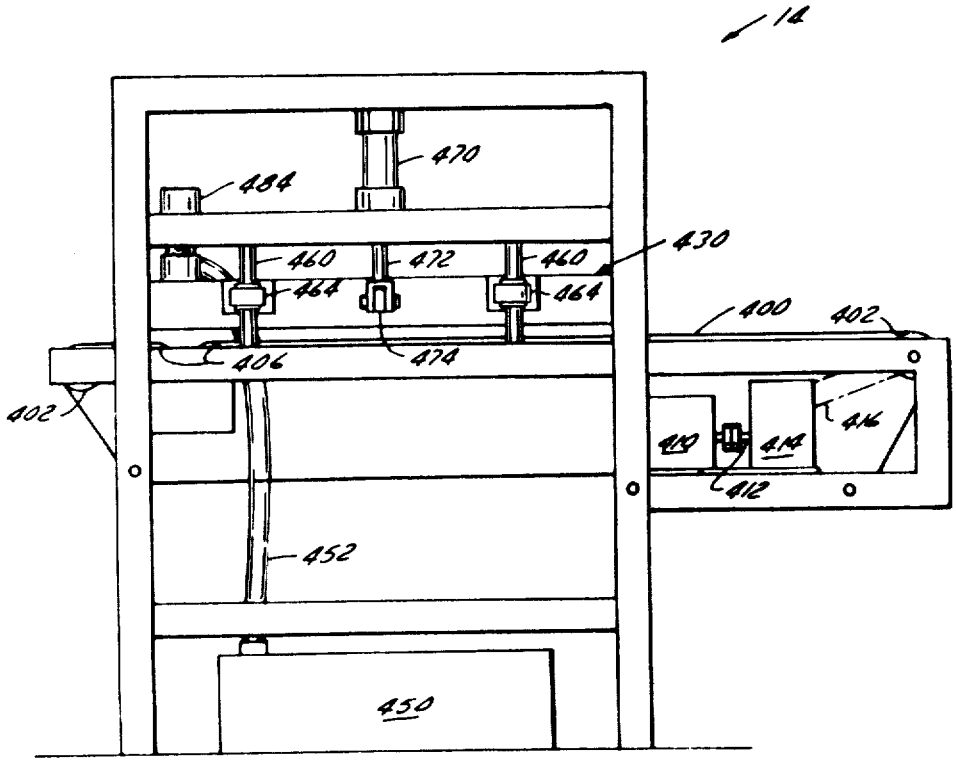
FIG. 6 is a side elevational view of the vacuum sealing device.

FIG. 14 appearing on the same sheet as FIG. 5, illustrates schematically the sealing and cutting assembly;

FIG. 15 is a section taken along the line 15—15 of FIG. 14.

Figure 16:
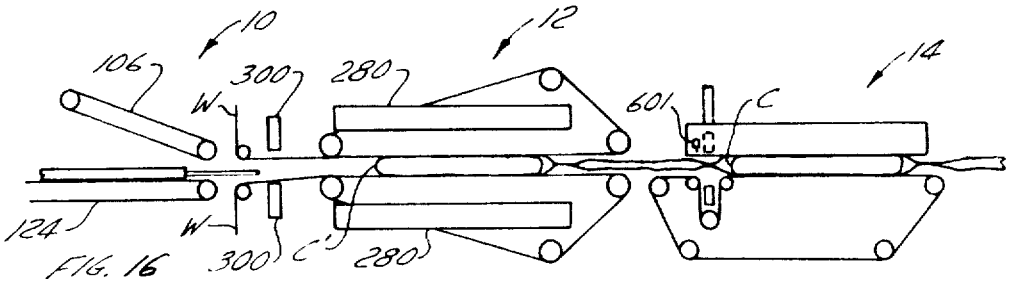
Figure 17:
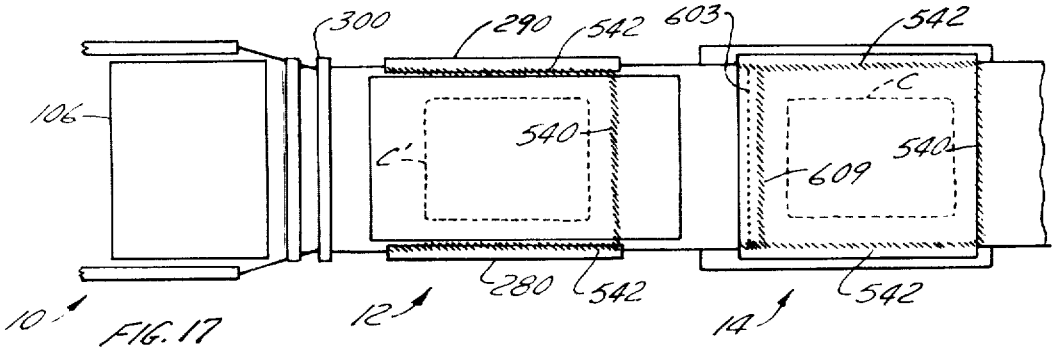
Figure 18:
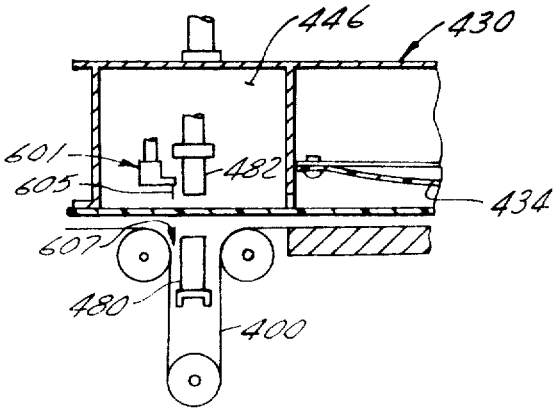
Figure 21:
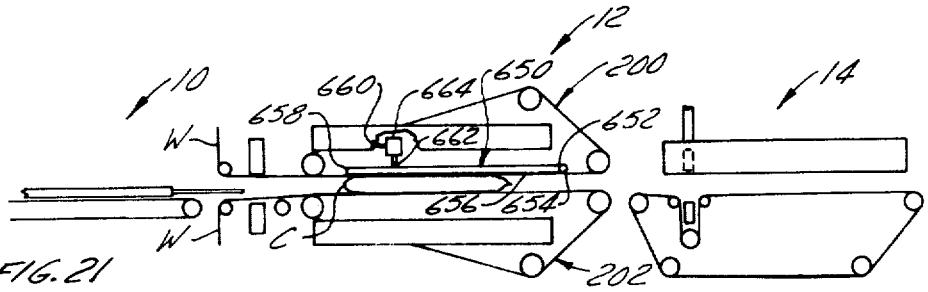
Figure 22:
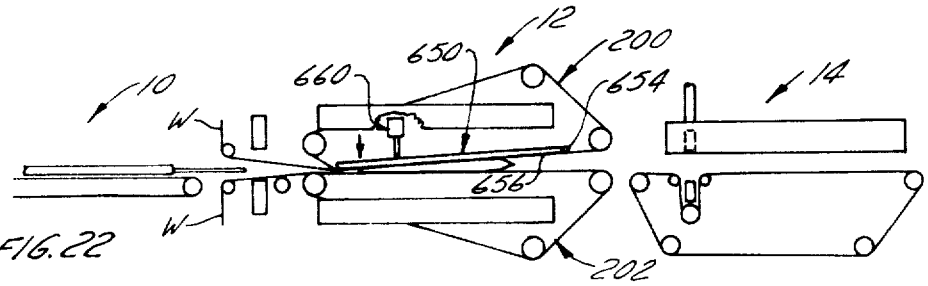
Figure 23:
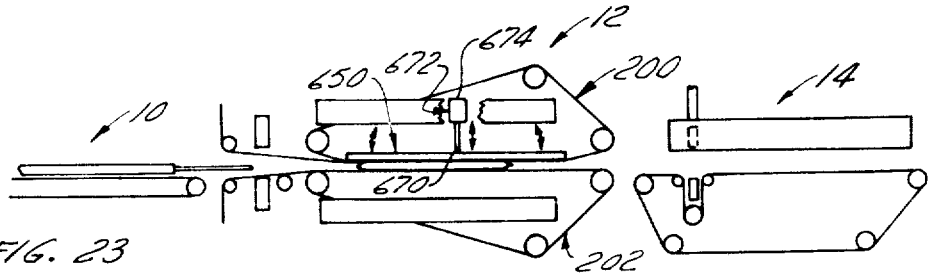
Figure 19:
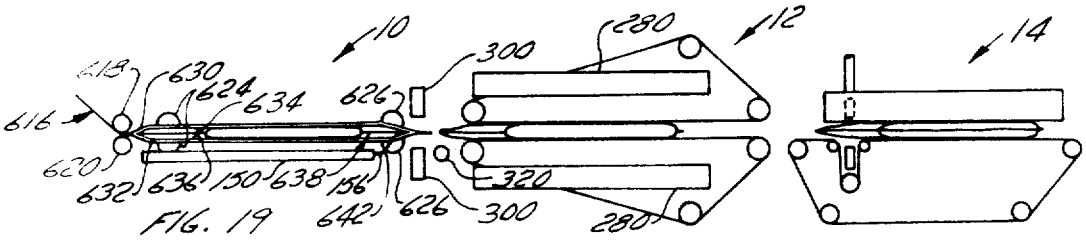
Figure 20:
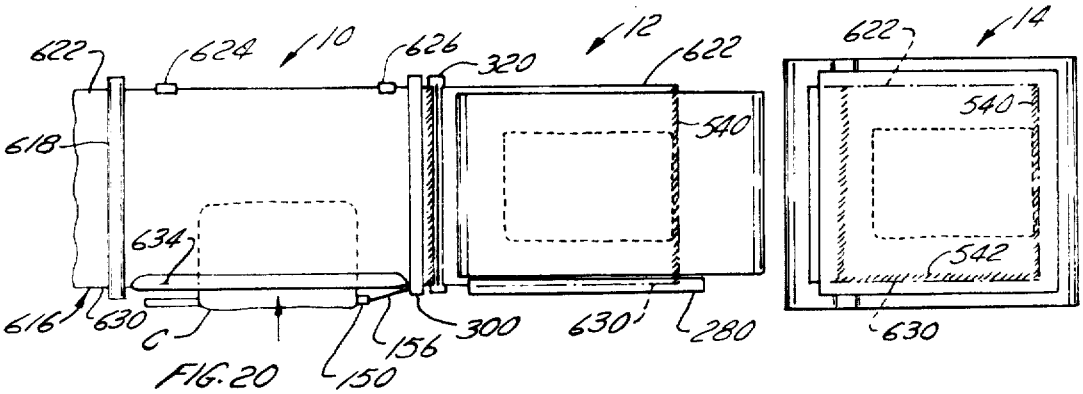

FIGS. 16 and 17 are schematic views showing the manner of perforating the film;

FIG. 18 is a detail cross-section view showing the perforation apparatus;

FIGS. 19 and 20 are schematic views showing the manner of employing C-shaped or U-shaped film;

FIGS. 21 and 22 are schematic views showing compressing of the commodity in the side-sealing assembly; and FIG. 23 is a schematic view showing another manner of compressing the commodity in the side-sealing assembly.

Figure 1:
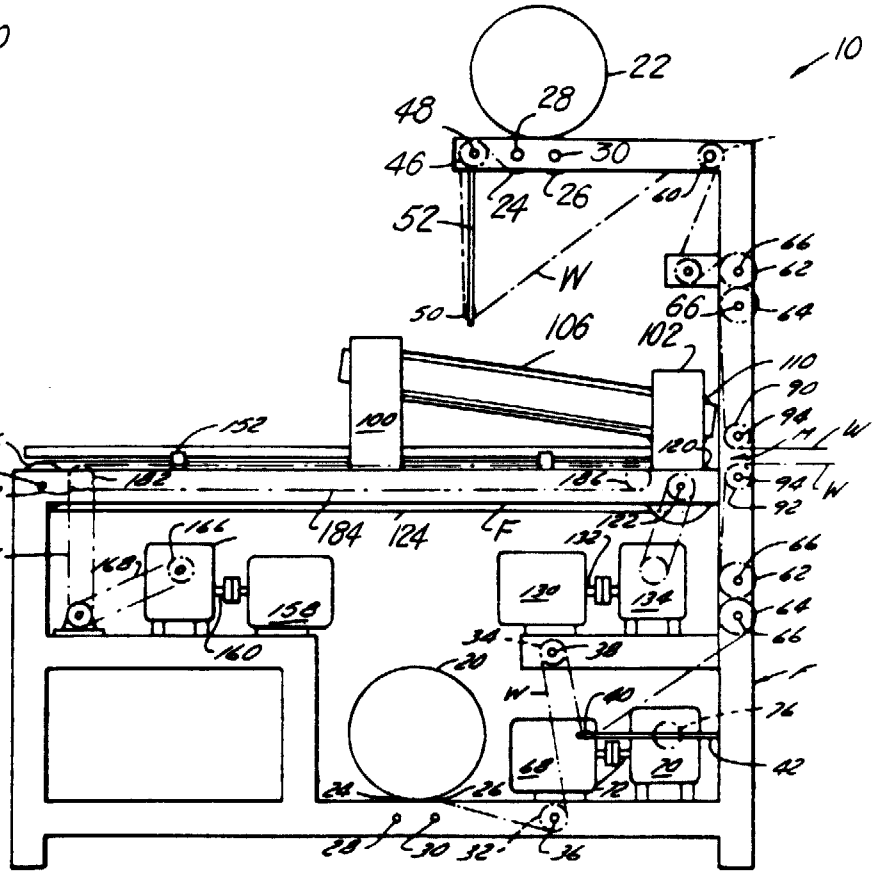
FIG. 1 is a side elevational view of one assembly of the apparatus.
Figure 2:
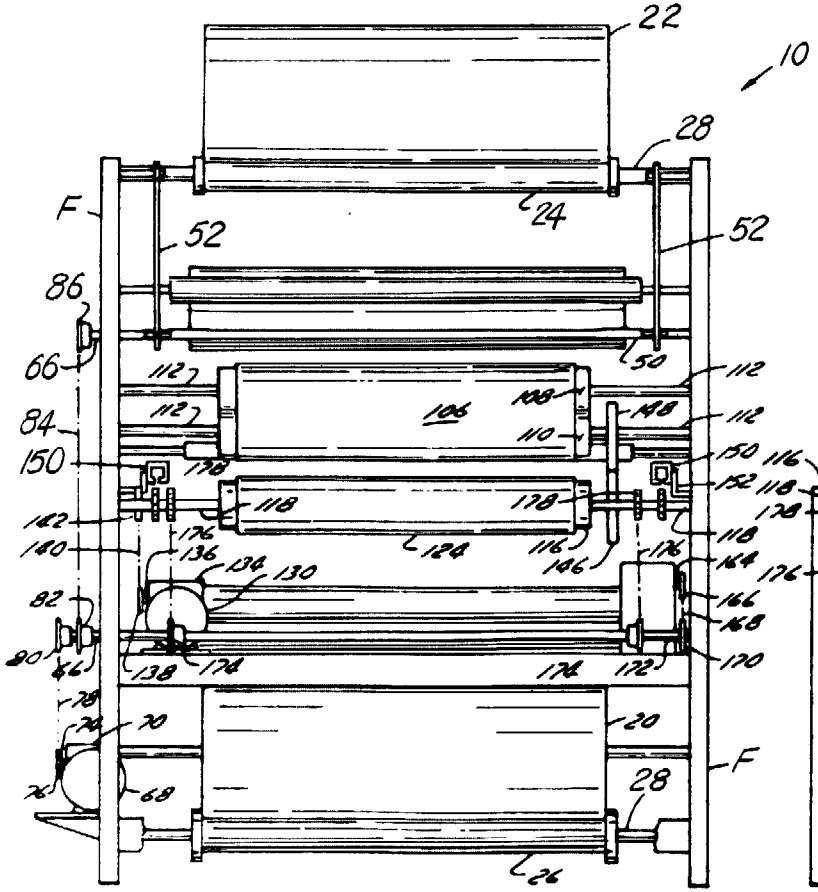
FIG. 2 is an end elevational view of the apparatus of FIG. 1.
Figure 3:
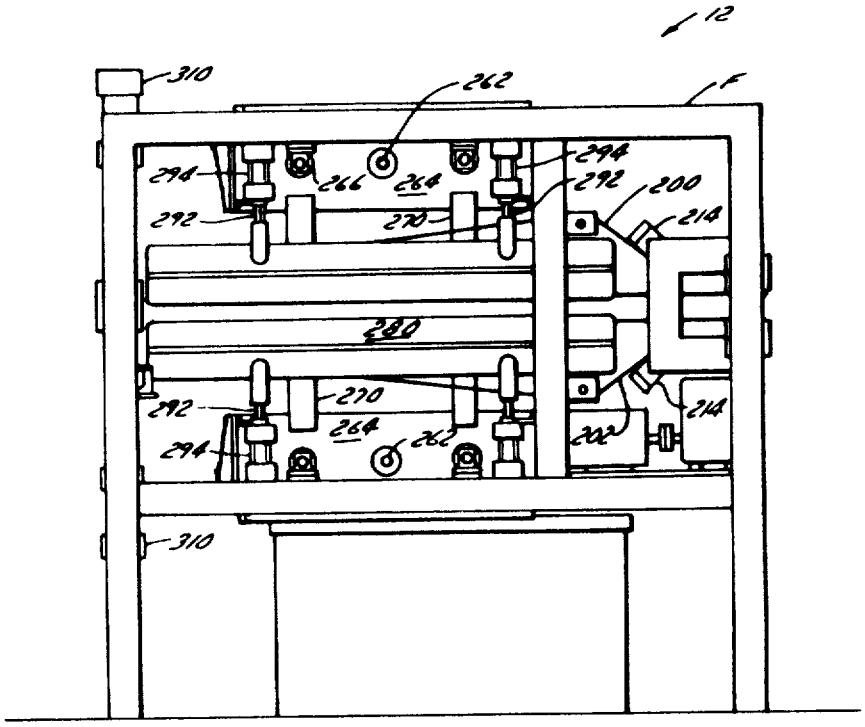
FIG. 3 is a side elevational view of the side sealing assembly of the apparatus.

Referring to FIG. 13, there is illustrated the basic wrapping apparatus comprising compression and commodity-feeding device 10; side sealing and advancing assembly 12; and the vacuum packaging and sealing apparatus 14. The wrapping material and commodity-feeding assembly 10 is shown in FIGS. 1 and 2 and includes, frame members F; all frame members will be referred to in general by reference letter F. A pair of continuous-length rolls of suitable wrapping material 20 and 22 are mounted on a pair of rotatable rollers 24 and 26, journalled between opposed frame members F by means of axles 28 and 30. A length of the flexible wrapping material is withdrawn from the roll and forms a web W so that top and bottom webs are fed to the bag-forming operation.

Guide rollers 32 and 34, journalled on shafts 36 and 38 between opposed frame members, are located to provide a path of travel for the web W from the supply thereof to the bag-forming operations. The lowermost section of the assembly, as shown in FIG. 1, includes an idler and tensioning arm or rod 40 supported on an arm 42 extending from the frame F of the apparatus, and the web W passes in engagement with the arm 40. The web W emanating from the upper roll 22 of wrapping material passes over a guide roller 46 journalled on a shaft 48 between opposed frame members; a pair of tensioning and idling arms 52 connected by means of a rotatable arm 50, are located in the path of travel of the web W from the guide roller 46. Thereafter, the web W passes over a further guide roller 58 journalled on the shaft 60 rotatably mounted between a pair of opposed frame members.

The drive means for the upper and lower webs W are a pair of cooperating rollers 62 and 64, journalled on shafts 66; at least one of the rollers 62 and 64 being driven by means of a motor 68 connected to a gear box 70 through shaft 72. The output shaft of the gear box 70 includes a drive shaft 74 mounting a sprocket 76, which in turn, mounts a drive chain 78 which rotates about a further sprocket 80 journalled on shaft 66 of one or both of the drive rollers 64 and 62. A second sprocket 82 mounted on the shaft 66 journals a further drive chain 84 which is operatively associated with a sprocket 86 connected to the shaft 66 of the upper drive rollers 62 and/or 64 to thereby rotate the upper rollers 64 and 62.

A feed path for the two web lengths is established by a pair of opposed spaced apart rotatable rollers 90 and 92, journalled on shafts 94, mounted between opposed frame members F of the apparatus. As shown in FIG. 1, two webs of material are fed over the various guide rollers and between the spaced apart rollers 90 to form a "mouth".

The apparatus includes a compression section including a pair of spaced apart upwardly extending frame members 100 and 102 connected to the frame F, and which support an upper movable belt 106 extending and rotating between the frame members 100 and 102. The belt 106 rotates between a pair of spaced apart rollers 108 and 110, each journalled on a shaft 112. Roller 108 is at a higher elevation from that of roller 110 whereby the belt 106 forms a decreasing angle towards the discharge end at support 102, adjacent to the mouth formed between the webs W and which will be hereinafter referred to by reference letter M.

The lower commodity advancing means operating in conjunction with the belt 106 comprises a front roller 116 journalled on a shaft 118 and a further roller 120 journalled on a shaft 122 at the opposed end (the discharge end) adjacent the mouth M and located generally beneath the roller 110. A continuous belt 124 extends between the rollers 116 and 120. The drive system for the upper and lower rotatable belts comprises a motor 130 connected by means of a drive shaft 132 to a gear box 134 which includes an output shaft 136 journalling a sprocket 138 and mounting a chain drive belt 140. The chain belt 140 is journalled on a further sprocket 142 mounted on the shaft 122 of the roller 120. The shaft 118, at its opposite end, includes a gear 146 mounted thereon, meshing with a further gear 148 mounted on shaft 112 journalling the roller 110. In this manner, the upper and lower belts are simultaneously rotated so as to advance a commodity C placed on the belt 124 towards and into engagement with the belt 106 to compress the same as it advances towards the mouth M at the discharge end.

Figure 10:
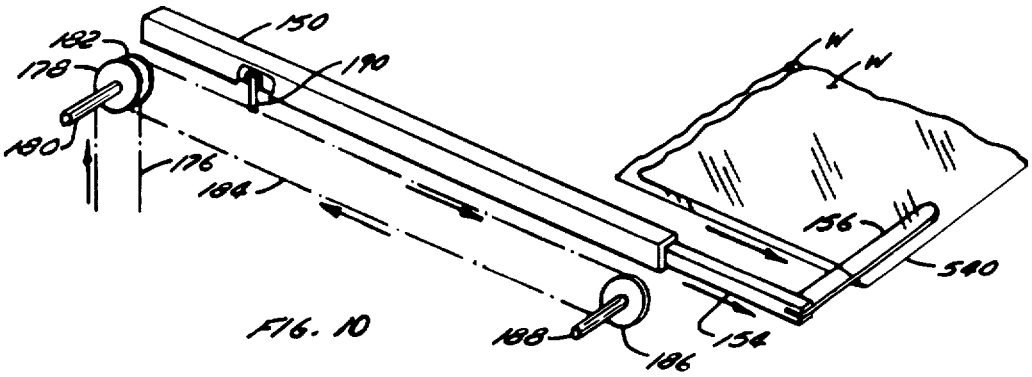
FIG. 10 is a schematic view showing a portion of the wrapper advancing mechanism employed in the apparatus of FIG. 1.

Referring now to FIGS. 1, 2 and 10, there is provided on either side of the belts 106 and 124, a pair of guide channels 150 of a generally inverted U-shape, which are fixedly secured to the frame F by means of brackets 152. Mounted in each of the channels 150 is an elongated slidable member 154 adapted for reciprocating movement therein. The members 154 have, at the projecting end thereof, a finger 156 pivotably associated therewith as will be described hereinafter with reference to FIGS. 11 and 12. The member 154 is adapted for reciprocating movement in channel 150 and movement is effected by means of a motor 158 driving a shaft 160 which in turn, is connected to a gear box 162. The output shaft 164 of the gear box journals a sprocket 166 about which there is mounted a chain drive belt 168. The chain drive is connected to a sprocket 170 journalled on shaft 172, which in turn, is journalled between opposed frame members F of the apparatus. Shaft 172, on each side, carries a further pair of sprockets 174, mounting a chain drive 176 which in turn, is associated with a further pair of sprockets 178. Sprockets 178 are mounted on a shaft 180 journalled between opposed frame members of the apparatus and shaft 180 journals a further sprocket 182 with a chain belt 184 associated therewith and rotating between sprockets 182 and a further sprocket 186 journalled on a further shaft 188 at the leading end of the movable member 154. Chain belt 184 includes at least one upwardly standing finger or like projection 190 fixedly secured thereto, which in turn, engages the member 154 through the open mouth in the bottom of the channel 150. Upon reciprocating movement of the chain drive 184 (and conversely through the other chain drives), the finger 190 will be effective to advance and retract the movable member 154 in the channel 150.

Figure 11:
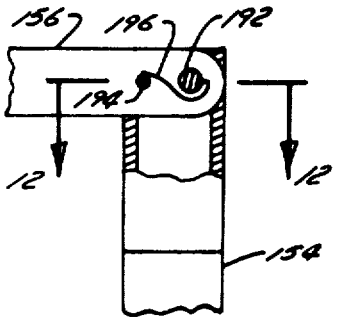
FIG. 11 is a detailed view showing a portion of the advancing apparatus illustrated in FIG. 10.
Figure 12:
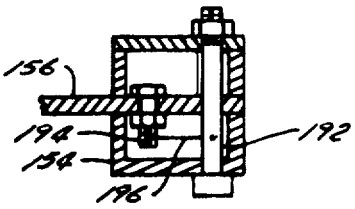
FIG. 12 is a section taken along the line 12—12 in FIG. 11.

As shown in FIG. 11, the finger 156 is pivotably connected to the member 154 on a shaft 192. The finger 156 is mounted to the reciprocating member 154 in a biased position whereby the finger 156 is normally urged into horizontal alignment with the member 154; to this end, the finger 156 includes a pin or bolt 194 to which is fixedly attached one end of a spring 196; the opposed end of the spring 196 is fixedly secured to the pivot 192 journalling the finger 156 to the arm 154.

The bag-forming, side-sealing and advancing unit 12 will be seen in FIGS. 3, 4, 5, 14 and 15; the unit includes guide rollers 204, 206 and 208 defining a guide path over which the belts rotate. Rollers 204, 206 and 208 are mounted on suitable shafts extending between opposed frame members. A further roller 210 forming a tension roller, for each of the upper and lower belt systems, may be included (see FIG. 5), rollers 210 being mounted on shafts 212 which are, in turn, journalled by adjustment blocks 214 attached to the frame, the adjustment blocks permitting adjustment of the amount of tension on the belts 200. The belts 200 are driven by means of a motor 216 connected to a shaft 218 which in turn, is connected to a gear box 220. The gear box 220 includes an output shaft 222 mounting a sprocket or the like 224, which in turn, journals a chain drive 226. The chain drive 226 is mounted over a further sprocket 228 fixed on a shaft 230 which supports the bottom front roller 206. At the opposed end of the shaft 230 there is provided a gear 232, meshing with a further gear 234 journalled on shaft 236 mounting the upper roller 206. In this manner, both the upper and lower shafts 206 are rotated simultaneously.

Figure 4:
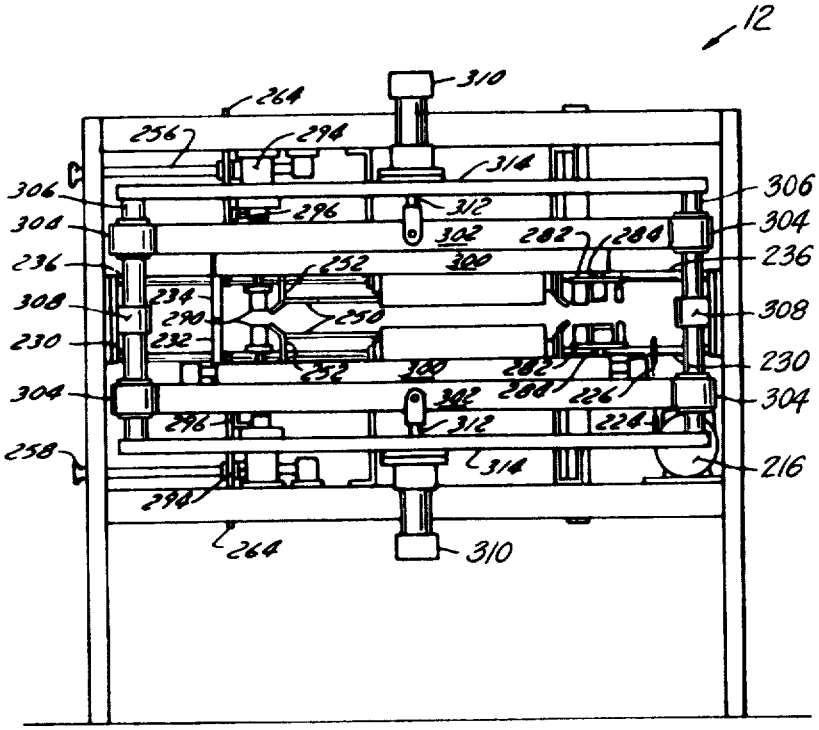
FIG. 4 is an end elevational view of the apparatus of FIG. 3.

In accordance with an optional feature of the present invention, the supports for the belts 200 may be varied in width and to this end, the apparatus includes a mechanism illustrated in greater detail in FIGS. 4 and 5. A plurality of spaced apart rods 250 fixedly secured to a frame member 252, operate in conjunction with a further frame member 254 containing a plurality of apertures sized to receive the rods 250. As illustrated in FIG. 5, the rods 250 preferably extend the full length of the belts 200 and can provide, if desired, an adjustment permitting articles of greater width to be processed in the assembly 12. As illustrated in FIG. 4, both the upper and lower portions of the apparatus may include the rods 250 to provide an extension for the upper and lower belts. Frame members 252 is movable by means of a screw thread device 256 mounted to the frame member F of the apparatus and which is manually rotatable by means of handle 258. The opposed end of the screw thread device 256 is journalled to frame member 260; the screw threads 262 threadably engage a mounting plate 264 which is movable laterally along the screw axis of the member 256 as the latter is rotated. Guide rods 266 slidably mount the plate 264; the rods 266 are journalled to frame member F and frame member 260 by means of bushings 268. Mounting member 264 is fixedly secured to plate 252 by means of brackets 270.

The assembly 12 includes sealing means comprising sealing units 280 having a pair of spaced apart sealing heads, each of which is mounted on a plate 282. Each plate 282 is mounted on a piston shaft 284 connected to a pneumatic piston assembly 286, one being located at either end (see FIG. 5).

The pair of sealing heads illustrated to the left hand side of FIG. 4 comprise an adjustable pair of sealing heads, each of which is indicated by reference numeral 290. Each of these sealing heads is mounted by means of a pair of spaced apart piston rods 292, which are actuated by a pneumatic cylinder 294. The cylinders 294 are mounted to the supporting plate 264 by means of a bracket 296. In this manner, the sealing heads are made adjustable to accommodate different widths as desired by movement as heretofore described.

The assembly 12 can include, in conjunction with the assembly 10, a sealing device and severing means adapted to form a leading seal between the pair of webs W, and to sever the sealed webs prior to advancing the same into the assembly 12. To this end, there is provided a pair of spaced apart sealing heads 300 each fixedly secured to a frame member 302 extending transversely across the webs W. The frame members 302 are journalled by means of bushings 304 on a vertical guide rod 306. The guide rods 306 are fixedly secured, intermediate their ends, by means of a further bushing 308. Movement of the supporting members 302, and hence the sealing heads, is achieved by means of a pneumatic cylinder 310 journalling a piston rod 312, which is fixedly secured to the supporting brackets 302 as illustrated in FIG. 4. As illustrated in FIG. 4, the ends of the shafts 306 may be supported further by means of a supporting member 314 extending between guide rods 306.

The cutting assembly (FIGS. 4, 14 and 15), preferably comprises a device known in the art as an "orega" assembly. As such, a pneumatic tube 320 containing a slit 322 therein, is mounted by a suitable bracket connected to the lower frame member 302 of the sealing head. Mounted interiorly of the member 320 is a piston member 324, which contains a knife or similar cutting device 326 ejecting through the aperture 322. The piston member 324 is freely slidable within the member 320 between its opposed end. Means are provided at each end of the tube (not shown) for selectively admitting pressurized air for driving the piston the length of the tube, to sever the webs.

The vacuum packaging and sealing apparatus 14 is illustrated in FIGS. 6 through 9 in detail and includes a movable belt drive for conveying a commodity between opposed pairs of web sections and delivered from the assembly 12. The belt is indicated by reference numeral 400 and is rotatable between guide rollers 402 on the top, guide rollers 404 on the bottom, and guide rollers 406 for directing the belt down and around a sealing head (to be described hereinafter). Drive means for the belt 400 is achieved through a motor 410 driving a shaft 412 connected to a gear box 414, with an output shaft (not shown) mounting a sprocket and in turn, journalling a chain belt 416 rotating, at one end, about a sprocket 418 journalled on a shaft 420 which mounts roller 402. Shaft 420 is journalled between opposed frame members F. The belt 400 passes over a supporting plate 424 fixedly secured to frame members of the assembly (see FIGS. 8 and 9) and forms the bottom or bed of the vacuum chamber (i.e., it forms a fixed non-compressible surface). The upper portion of the vacuum chamber is defined by means of a housing 430, surrounding the conveying assembly. The side walls 432 of the housing 430 mounts a flexible membrane 434 spaced upwardly from the lower edges of the side walls 432; the membrane 434 is secured to the side walls by means of a flange 436 and appropriate fastening means such as bolts or the like 438. The lower edge of the side walls 432 includes a further flange 440 having fixedly secured thereto a gasket or other like sealing material, extending about the periphery of the housing 430. In this manner, the gasket is intended to form with the supporting plate 424 an air-tight enclosure.

One of the side walls 432 is in communication, via apertures 444, with a vacuum chamber indicated generally by reference numeral 446. The chamber 446 is connected to a vacuum pump 450 by means of a conduit 452.

The housing 430 is movable vertically from a raised position to a closed position; to this end, the housing 430 is journalled on shafts 460 by means of bushings 464. The shafts 464 are fixed at each end to supporting members 466 which in turn are fixed to frame members F whereby the housing 430 is free to slide up and down on the shafts 460. Movement is effected by means of a piston assembly 470 mounting a piston rod 472 which is fixedly secured to the housing 430 by means of a bracket 474.

Figure 7:
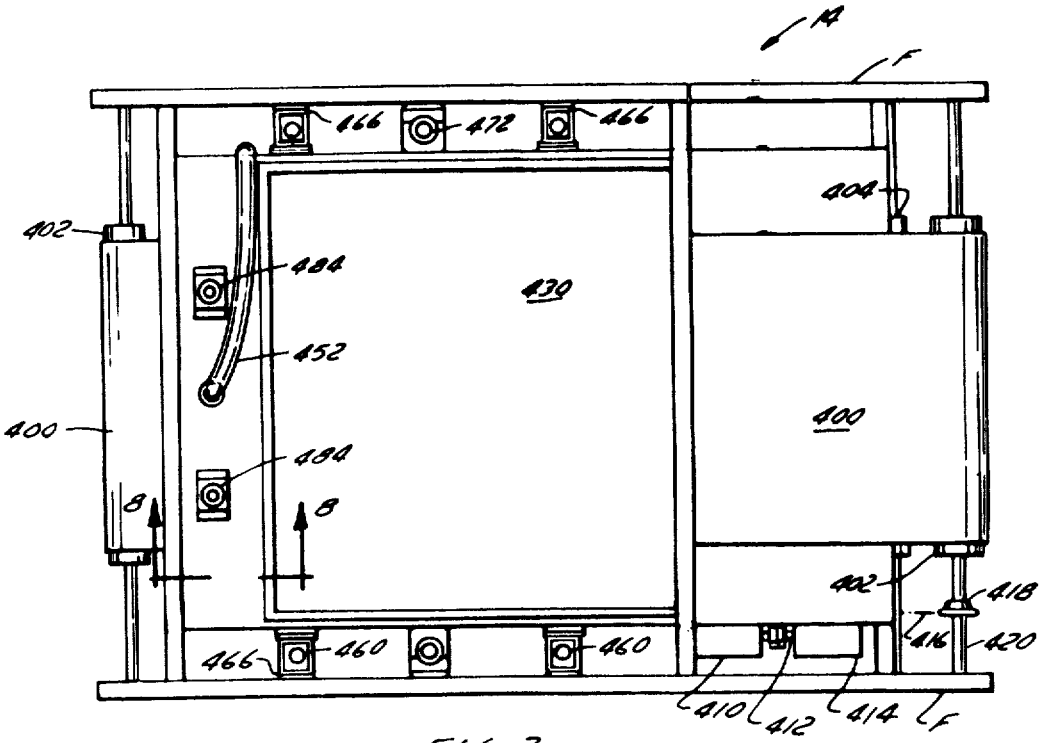
FIG. 7 is a top plan view of the device of FIG. 6.
Figure 8:
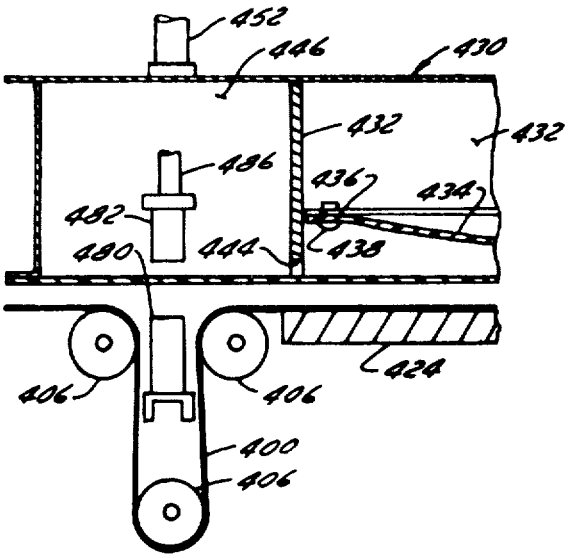
FIG. 8 is a cross-sectional detailed view of a portion of the vacuum packaging and sealing unit taken along the line 8—8 of FIG. 7.
Figure 9:
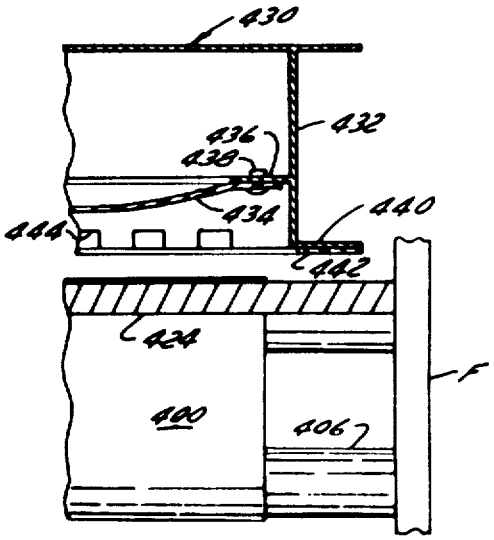
FIG. 9 is a view similar to FIG. 8 but showing further detail of the vacuum packaging assembly.

As illustrated in FIGS. 7 and 8, there are provided sealing means for sealing the trailing end of the wrapped commodity received in the assembly 14; to this end, there are provided a pair of spaced apart sealing heads 480 and 482, the lower of which is fixedly secured to a frame member and the upper of which is movable. As will be seen from FIG. 8, the lower sealing head is journalled between opposed sections of the belt 400 (which forms a portion of the vacuum chamber at the point where it extends downwardly as illustrated in FIG. 8). The upper sealing head 482 is movable and is adapted to be brought into engagement with the lower sealing head 480 by means of a pair of piston assemblies 484, attached thereto by means of piston rod 486.

The construction of the sealing head is illustrated in greater detail in FIG. 15 and includes a supporting or backing member 500 of suitable material; a resilient backing member 502 is partially embedded in the body 500 with an overlying wire mesh layer 504 surrounding the member 502. The mesh serves as a heat dissipating member, and is covered with a backing layer 506 of suitable material. The heating element 508 is mounted over the backing member 502 on the backing layer 506 and is covered by means of a facing material of suitable characteristics as indicated by reference numeral 510. The layers of various material may be fixedly secured to the body 500 by means of suitable tape or the like 512.

Referring now to FIGS. 13A through 13F, the operation of the apparatus described above is illustrated in detail. To this end, referring initially to FIG. A, a commodity C is shown as being fed onto the advancing belt 124 for processing; in commencing the operation of the apparatus, it will be noted from FIG. 13A that the pair of webs W are initially sealed at their leading ends (prior to entry into the side-sealing and advancing assembly 12) from a previous operation of the unit—the seal on the web being indicated generally by reference numeral 540. As the commodity C is advanced along the belt 124, it engages with the moving belt 106 and is subject to compression by virtue of the converging belts 124 and 126.

Figure 13A:
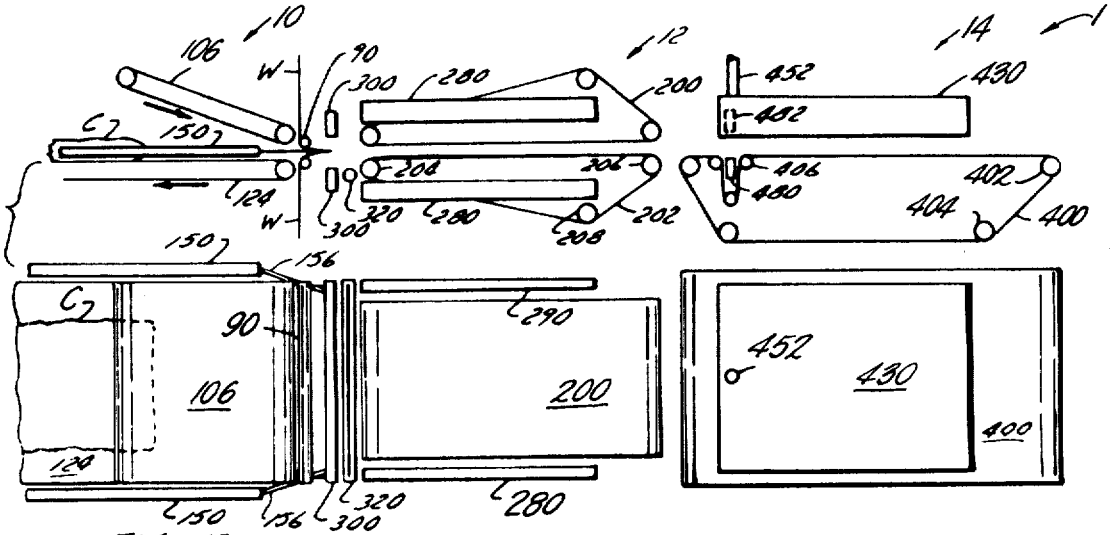
FIGS. 13A to 13F illustrate schematically, the various steps in the operation of the apparatus through its various stages.
Figure 13B:
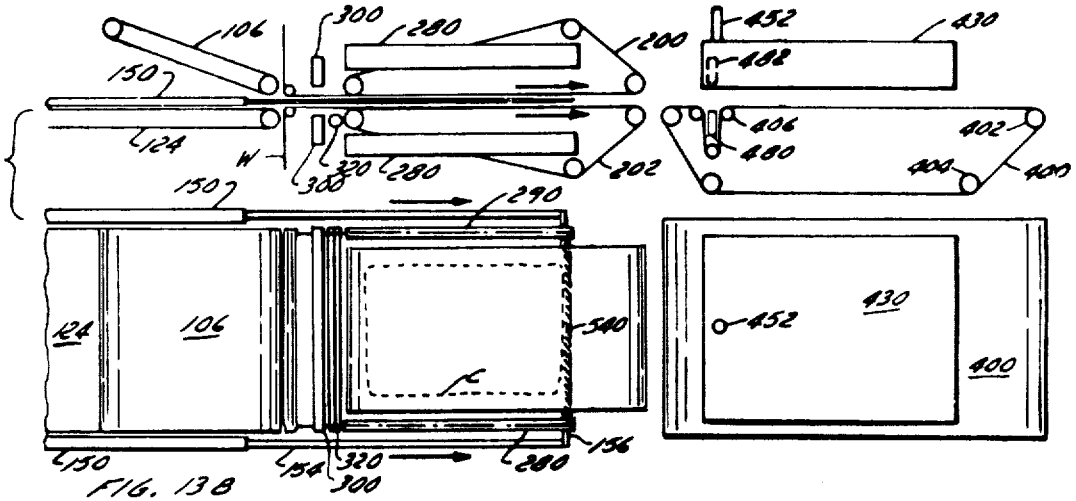
Figure 13C:
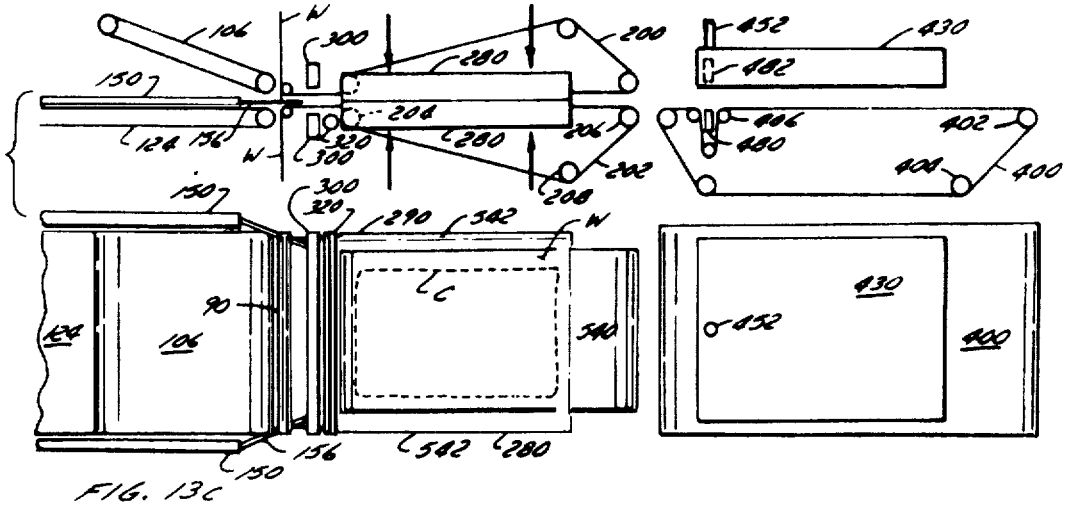

At the onset of the operation, the fingers 156 are placed between the pair of webs W and brought into engagement with the seal 540. In conjunction with the advancement of the commodity C through the discharge end of the belts 106 and 124, the advancing member 154 is actuated to advance the assembly with the fingers 156 and thus advance the sealed web into the assembly 12 and between the spaced apart belts 200 and 202 which then assume control of the commodity within the partially formed wrapper or bag. The commodity, as it is illustrated in FIG. 13B, is shown as being advanced into the assembly 12 and following advancement of the commodity under control of the belts 200 and 202 of the assembly 12, the fingers 156 are moved from engagement and from controlling the partially packaged commodity by the reverse movement of the assembly 154 whereby the fingers, being biased forwardly, are then brought clear of the commodity and returned to the initial position for subsequent advancement of a further operation. At this point, the side sealing assemblies 280 and 290 are actuated to seal the sides of the web and to form a side-sealed and bottom-sealed wrapper or bag, as illustrated in FIG. 13C—the side seal being indicated generally by reference numeral 542.

Figure 13D:
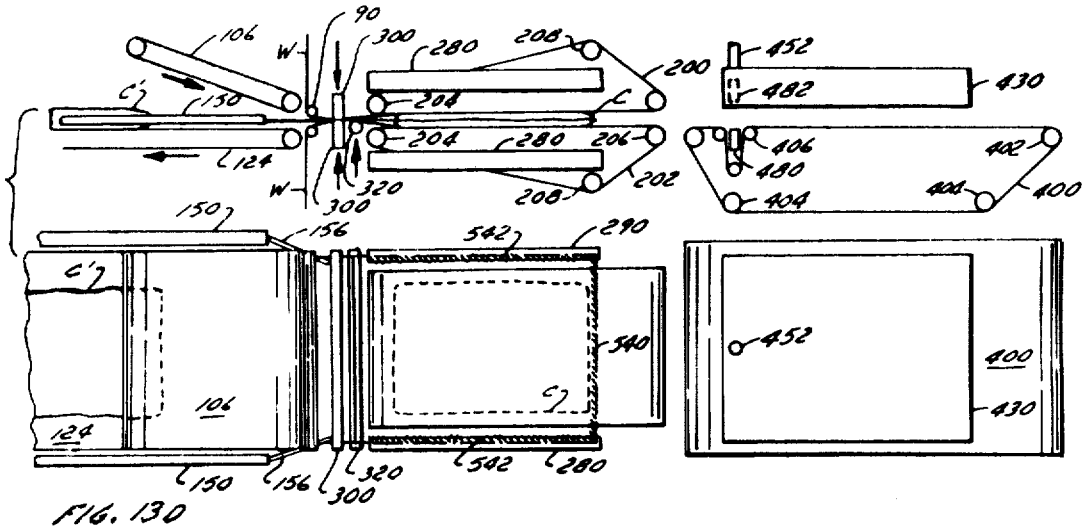

Thereafter, the sealing members 300 are actuated to effect a further seal 540' for the subsequent operation, and at the same time, the webs in the leading direction (in the direction of movement of the webs) are severed (see FIG. 13D).

Figure 13E:
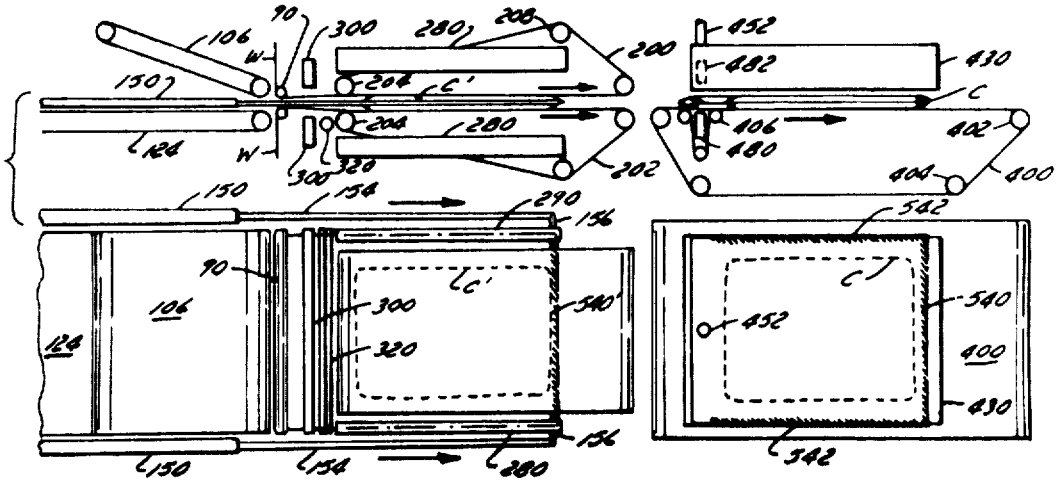
Figure 13F:
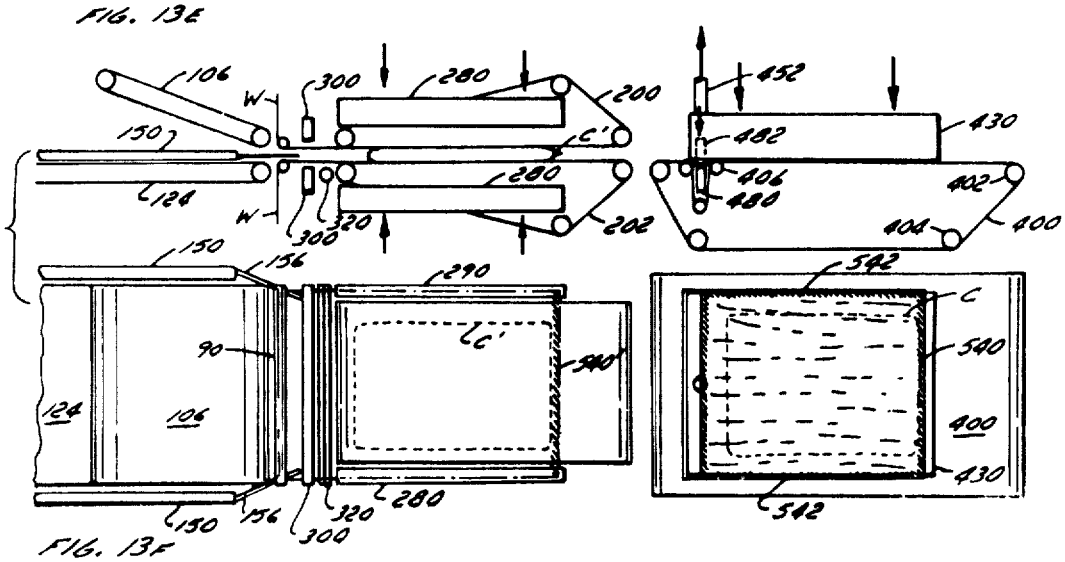

Following the sealing and cutting operation, and referring to FIG. 13E, the severed bag or wrapper unit containing the commodity is advanced into the assembly 14 for final vacuum packaging and sealing. At that point, the housing 430 is lowered once the belt 400 positions the partially wrapped commodity at the desired position within the housing 430. Housing 430 is lowered and a partial vacuum is applied by means of vacuum pump 450. The flexible membrane is then brought into contact with the wrapped commodity, the same is further compressed and air removed from the package or wrapper, following which the final seal is applied by means of sealing heads 480 and 482, as illustrated in FIG. 13F.

The above assemblies indicated by reference numerals 10, 12 and 14, may be operated on an intermittent basis whereby a commodity being fed through the assembly 10 is brought into contact with the webs of material W while a further commodity is being side-sealed in the assembly 12 and a still further commodity is being vacuum packaged in the assembly 14. Thus, each assembly may be operated in a time-intermittent manner through a suitable control device controlling the operation of all three assemblies.

The above structural and operational descriptions relate to known packaging machines. In accordance with the present invention, this known packaging machine can be modified to provide a continuous strip of packaged commodities. In the modified packaging machine, the pair of film layers are not severed to provide individual packages. Instead, the film layers are transversely perforated between each pair of adjacent packaged commodities. The strip of packaged commodities can then be transported as a single unit from the machine to a place of use where the commodities are separated from each other along the rows of transverse perforations.

As shown in FIGS. 16 to 18, the compression and commodity-feeding device 10 and the side sealing and advancing assembly 12 are substantially unchanged. The commodity C is still advanced between the compression belts 106, 124 of the device 10 and between the upper and lower film layers W, into the side sealing assembly 12. In the side sealing assembly 12, the sides of the film layers are sealed together by heat sealers 280, 290 as shown by side heat seals 542. The leading end of the two film layers W had been previously heat sealed together along seal 540 by transverse heat sealer 300 located at inlet end of the side sealing assembly 12.

From the side sealing assembly 12, the commodity C is fed to the vacuum packaging and sealing apparatus 14. The film layers W have not been cut, the cutter 320 in the known machine adjacent the transverse heat sealer 300 being rendered inoperative, or removed. As the commodity C is moved into the apparatus 14, a second commodity C' is moving into assembly 12 between the same continuous film layers W. In the apparatus 14, perforating means 601 are mounted within the vacuum chamber 446. The perforating means 601 are located adjacent the sealing means 482 in the vacuum head on the inlet side of the apparatus. The perforating means 601 are of the type which perforate both film layers W in a transverse row of perforations 603 without sealing the film layers W together. The perforating members 605 penetrate the films W into the loop space 607 formed in bottom belt 400 to receive bottom sealing head 480. The members 605 do not, however, interfere with head 480. Suitable means (not shown) are provided within the vacuum chamber for actuating the perforating means 601 to perforate the film layers.

Once the film layers W have been perforated, a vacuum is applied in the vacuum chamber 446 to evacuate the space within the film layers W enclosing the commodity within the housing 430 through the perforations 603. The diaphragm 434 moves to flatten the commodity C. The sealing means 480, 482, located between the row of perforations 603 and the commodity "C", are then operated to provide a transverse heat seal 609 extending between the longitudinal side heat seals 542 to fully seal the commodity "C" between the film layers W. The sealed commodity C is then moved out of the apparatus 14 and the following commodity C' moves into the apparatus 14, both commodities still joined by the film layers W. After commodity C' has been vacuum sealed in apparatus 14 and moved out, the two commodities can be separated anytime by tearing along the transverse row of perforations 603 without breaking the heat seals which vacuum package both commodities.

The embodiment described above employs perforating means 601 which do not seal the layers W together. However perforating means which seal the layers together at the perforations could be employed, provided other cutting means are provided within the vacuum chamber 446 for cutting holes or slots in the film layers so that air can be evacuated from between the film layers about the commodity prior to sealing them together.

In another embodiment of the invention, the commodity feeding device 10 is modified so that the machine can use U-shaped or C-shaped film. As shown in FIGS. 19 and 20, the C-shaped film 616 is fed through a pair of transverse feed rollers 618, 620 at the inlet side of the device. The fold 622 in the film 616 is guided through the commodity-feeding device 10 along one side by a first pair of guide rollers 624 near the inlet end of the device adjacent the feed rollers 618,620, and by a second pair of guide rollers 626 adjacent the outlet end of the device 10. The second pair of guide rollers 626 is preferably driven to help draw the film 616 through the device.

The free edges 630, 632 of the film 616 on the other side of the device are guided over a pair of spaced-apart guide plates 634,636 which between them form an inlet mouth 638 through which commodities "C" are fed laterally in between the film layers. The commodities "C" are fed transversely one at a time through inlet mouth 638 by any suitable conveying means (not shown).

A feeding finger 156 is retained with the device on the one side adjacent the guide plates 634, 636. The channel 150 guiding the finger 156 is located just below the bottom guide plate 634 so as not to interfere with the lateral loading of the commodity C in between the film layers. The finger 156 is vertically offset from the guide channel as shown at 642 so as to be insertable between the film layers. The finger 156 can be lengthened to extend across a substantial portion of the film layers. The finger 156 is moved synchronously with the drive rollers 626 to move the C-shaped film with the inserted commodity through the device 10. The top compression belt 106 is not needed in this embodiment. The bottom belt (while not shown) can be retained to support the commodity C, moving in synchronism with the rollers 626.

The sealing bars 300 adjacent the outlet end of the device 10 effect a transverse seal 540 on the C-shaped film 616. The film 616 is then moved into the side-sealing assembly 12 which has been modified by deleting the side sealing unit on the side of assembly where the fold 622 of the film passes. Only the side of the film adjacent the free edges 630, 632 need be sealed with sealing bars 280 to provide a side seal 542. The cutter 320 then cuts the film 616 and the commodity C is then moved to the vacuum apparatus 14 which operates as before to flatten, evacuate, and end seal the package. In this embodiment only three heat seals are needed to form the package since the fourth heat seal is eliminated by the fold 622.

If desired, the cutter 320 could be eliminated and the C-shaped film could be perforated instead by modifying the vacuum apparatus 14 as described above and as shown in FIGS. 16 to 18.

In another embodiment of the invention as shown in FIGS. 21 to 23, the commodity C can be compressed in the side-sealing assembly 12 rather than in the commodity-feeding device 10 if desired. As shown in FIGS. 11 and 22, a compression plate 650 can be pivotably mounted within the upper drive belt 200 of assembly 12. The plate 650 is pivotably mounted at one end 652, adjacent the outlet side of the assembly, by a hinge 654 fixed to the frame (not shown) of the assembly 12. The plate 650 normally lies closely adjacent the horizontal run 656 of belt 200. Means are provided adjacent the other end 658 of the plate 650 for moving the plate down about hinge 654 to move belt 200 and thus compress the commodity C between belt 200 and belt 202. The moving means can comprise a hydraulic cylinder 660, fixed pivotably at one end 662 to the frame and at its other end 664, pivotably to the plate 650.

In a modified version, as shown in FIG. 19, the plate 650 can be universally connected at its center to one end 670 of a hydraulic cylinder 672, the other end 674 of which is fixed to the frame. Operation of the cylinder 672 will move the plate 650 down to compress the commodity between belts 200 and 202, the central universal connection allowing the plate 650 to float while compressing.

In both modifications where the compressing plate 650 is used in the side-sealing assembly 12, the commodity-feeding device 10 is modified to delete the upper compression belt. The compressing plate 650 can be used in the machines employing perforators, or in the machines modified to handle C-shaped film.

It will be understood that various modifications may be made to the above-described embodiments without departing from the spirit and scope of the invention. Thus, this invention contemplates that the apparatus and method may be employed in conjunction with other operations such as a manufacturing operation in which the commodities produced from the manufacturing operation are automatically fed into the system of the present invention, to be wrapped. In some cases, it may not be necessary to compress the commodities or put the commodities under vacuum packaging but for most products such as insulation products, garments and the like, this is highly desirable.

We claim:

1. An apparatus for wrapping a commodity comprising, in combination, means for supplying a pair of spaced apart layers of air-impermeable wrapping material each having a free lateral edge and for placing said pair of layers of wrapping material in registry, said layers of wrapping material being secured together along a leading edge to form an open-sided partial envelope having a closed leading portion, means for advancing a commodity along a path into engagement with said wrapping material between said layers of wrapping material, means for sealing the free lateral edges of said layers of wrapping material together to form an envelope having at least one closed lateral side and a closed leading portion with said commodity therein, means for perforating said opposed lengths of wrapping material across the width thereof to form a container length, and means for sealing the balance of said pair of layers of wrapping material of the envelope to form a wrapped commodity enclosed in a wrapper.

2. An apparatus as defined in claim 1, wherein said means for supplying a pair of spaced apart layers of wrapping material comprises means for supplying a length of "C" shaped film.

3. An apparatus as defined in claim 2, wherein said means for severing comprises severing means to sever container lengths of material from said supply thereof.

4. An apparatus as defined in claim 2, wherein said severing means is positioned subsequent to said supply means in the direction of advancement of the material by said supply means.

5. An apparatus as defined in claim 2, wherein there is included means for compressing said commodity after said commodity has been advanced between said layers of wrapping material.

6. A method of wrapping a commodity comprising the steps of supplying a commodity to be wrapped, supplying a pair of spaced apart layers of air-impermeable wrapping material each having a free lateral edge, placing said layers of wrapping material in registry, said layers of wrapping material being secured together along a leading edge to form an open sided partial envelope having a closed leading portion, advancing a commodity along a path into engagement with the wrapping material between said layers of wrapping material, sealing the free lateral edges of said layers of wrapping material together to form an envelope having at least one closed lateral side and a closed leading portion with said commodity therein, perforating said opposed lengths of wrapping material across the width thereof to form a container length, and sealing the balance of said pair of layers of wrapping material of the envelope to form a wrapped commodity enclosed in a wrapper.

7. A method as defined in claim 6, wherein the step of supplying said wrapping material comprises supplying a length of "C" shaped film.

8. A method as defined in claim 6, which includes the step of compressing the commodity in the envelope after the commodity has been inserted between the layers of wrapping material.

9. A method as defined in claim 6, comprising the further steps of subjecting said commodity to a compression step, maintaining said commodity under compression while at least partially sealing the free edges of the wrapping material, subjecting the resulting commodity to a vacuum packaging the step by placing said commodity on a fixed surface, contacting said commodity in said envelope with a flexible membrane with said flexible membrane and said fixed surface defining therebetween a vacuum chamber, evacuating air from said chamber and permitting the flexible membrane to compress and evacuate air from the envelope containing said commodity, and upon evacuation of air from said commodity and said envelope, sealing the balance of the open edges of the envelope to form a vacuum packaged compressed commodity.

10. A method as defined in claim 6, wherein the step of subjecting the commodity to compression comprises the step of placing said commodity between a pair of opposed converging belts, and said step of maintaining the commodity under compression while said side edges of said wrapping material are sealed is carried out by maintaining said commodity under compression under a pair of spaced-apart compression belts.

11. A method as defined in claim 6, wherein said spaced-apart belts are movable whereby the commodity is advanced from said sealing step to said vacuum packaging and sealing step by said movable belts.

12. An apparatus for wrapping a commodity comprising, in combination, means for supplying a U-shaped film of air-impermeable wrapping material and having opposed free lateral edges in registry, said wrapping material being secured together along a leading edge to form an open sided partial envelope having a closed leading portion, means of advancing a commodity along a path into engagement with said wrapping material between said free lateral edges, means for sealing the free lateral edges of said wrapping material to form an envelope having a closed leading portion with said commodity therein, means for severing said opposed lengths of wrapping material across the width thereof to form a container length.

13. An apparatus as defined in claim 12, wherein said means for compressing said commodity comprises a movable compression plate positioned above said commodity and movable into and out of commodity compressing relationship.

14. An apparatus as defined in claim 12, further comprising means for vacuum-packaging said commodity in said envelope, said last mentioned means being positioned in advance of the direction of movement of said commodity and being effective to vacuum package said commodity in said envelope prior to said envelope being completely sealed by said sealing means.

15. An apparatus as defined in claim 14, wherein said vacuum packaging means comprises a fixed rigid surface and an opposed flexible surface, means for bringing said surfaces into and out of engagement to form therebetween a vacuum chamber, means for evacuating the air from said vacuum chamber, sealing means in said vacuum chamber adapted to seal a partially sealed envelope, means for advancing an envelope into said chamber and means for discharging a commodity in a sealed evacuated envelope from said chamber.

* * * * *